US010900617B2

(12) United States Patent
Wang et al.

(10) Patent No.: US 10,900,617 B2
(45) Date of Patent: Jan. 26, 2021

(54) LIGHT BULB APPARATUS

(71) Applicant: XIAMEN ECO LIGHTING CO. LTD., Xiamen (CN)

(72) Inventors: Qiyuan Wang, Xiamen (CN); Yunnan Lin, Xiamen (CN); Liping Lin, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 17/008,532

(22) Filed: Aug. 31, 2020

(65) Prior Publication Data

US 2020/0393091 A1 Dec. 17, 2020

Related U.S. Application Data

(63) Continuation of application No. 16/847,976, filed on Apr. 14, 2020, which is a continuation of application No. 16/670,545, filed on Oct. 31, 2019, now Pat. No. 10,655,796, which is a continuation of application No. 16/445,123, filed on Jun. 18, 2019, now Pat. No.

(Continued)

(51) Int. Cl.

| | |
|---|---|
| ***H01K 1/00*** | (2006.01) |
| ***F21K 9/235*** | (2016.01) |
| ***F21V 17/12*** | (2006.01) |
| ***F21V 23/00*** | (2015.01) |
| ***F21K 9/238*** | (2016.01) |
| ***F21K 9/232*** | (2016.01) |
| ***F21V 29/70*** | (2015.01) |
| *F21K 9/68* | (2016.01) |
| *F21Y 115/10* | (2016.01) |
| *F21V 19/00* | (2006.01) |

(Continued)

(52) U.S. Cl.

CPC ..... *F21K 9/235* (2016.08); *F21K 9/232* (2016.08); *F21K 9/238* (2016.08); *F21V 17/12* (2013.01); *F21V 23/005* (2013.01); *F21V 29/70* (2015.01); *F21K 9/68* (2016.08); *F21K 9/69* (2016.08); *F21V 5/045* (2013.01); *F21V 7/0091* (2013.01); *F21V 19/0055* (2013.01); *F21V 23/06* (2013.01); *F21V 29/773* (2015.01); *F21V 29/83* (2015.01); *F21Y 2103/33* (2016.08); *F21Y 2115/10* (2016.08); *H01R 33/22* (2013.01)

(58) Field of Classification Search

CPC .... H01R 33/09; H01R 13/26; H01R 13/5216; H01R 13/521

USPC ..... 439/617, 918, 699.2, 276, 936

See application file for complete search history.

(56) References Cited

U.S. PATENT DOCUMENTS 7,025,612 B1 * 4/2006 Keilholz ..... H01R 33/22 429/230

7,284,895 B2 * 10/2007 Goto ..... H01R 13/5205 313/318.09

(Continued)

*Primary Examiner* — Phuong Chi Thi Nguyen

(74) *Attorney, Agent, or Firm* — Chun-Ming Shih; LanWay IPR Services

(57) ABSTRACT

A light bulb apparatus has a plurality of LED modules, a substrate, a driver circuit board, a plastic piece, a radiator and a lamp cap. The substrate has aluminum material for mounting the plurality of LED modules, a first connection end and a second connection end. The first connection end and the second connection end are electrically connected to the plurality of LED modules. The plastic piece with a guiding groove is used for inserting the driver circuit board. The radiator has a top plate and a side wall. The substrate is fixed on the top plate, and the side wall are connected to the plastic piece.

20 Claims, 9 Drawing Sheets

Related U.S. Application Data

10,495,265, which is a continuation of application No. 16/254,149, filed on Jan. 22, 2019, now Pat. No. 10,364,943, which is a continuation of application No. 16/126,790, filed on Sep. 10, 2018, now Pat. No. 10,222,003, which is a continuation of application No. 15/944,784, filed on Apr. 3, 2018, now Pat. No. 10,100,983, which is a continuation of application No. 15/805,503, filed on Nov. 7, 2017, now Pat. No. 9,970,599, which is a continuation-in-part of application No. 15/632,873, filed on Jun. 26, 2017, now Pat. No. 9,841,148, which is a continuation of application No. 15/432,009, filed on Feb. 14, 2017, now Pat. No. 9,719,638, which is a continuation of application No. 15/113,837, filed as application No. PCT/CN2015/071518 on Jan. 24, 2015, now Pat. No. 9,605,811.

(51) Int. Cl.

| | |
|---|---|
| *H01R 33/22* | (2006.01) |
| *F21V 29/77* | (2015.01) |
| *F21V 29/83* | (2015.01) |
| *F21V 23/06* | (2006.01) |
| *F21Y 103/33* | (2016.01) |
| *F21V 5/04* | (2006.01) |
| *F21V 7/00* | (2006.01) |
| *F21K 9/69* | (2016.01) |

(56) References Cited

U.S. PATENT DOCUMENTS

| | | | | |
|---|---|---|---|---|
| 7,306,488 | B2 * | 12/2007 | Krijne | H01R 33/06 439/617 |
| 8,226,440 | B2 * | 7/2012 | Mouchon | H01R 13/64 439/617 |
| 2006/0187682 | A1 * | 8/2006 | Goto | H01R 13/5205 362/652 |
| 2010/0311267 | A1 * | 12/2010 | Mouchon | H01R 13/6272 439/375 |

* cited by examiner

LIGHT BULB APPARATUS

CROSS REFERENCE

The present application is a continuation application of U.S. application Ser. No. 16/847,976, which is a continuation application of U.S. application Ser. No. 16/445,123, which is a continuation application of U.S. patent application Ser. No. 15/944,784 filed on Apr. 3, 2018, which is a continuation application of U.S. patent application Ser. No. 15/805,503 filed on Nov. 7, 2017, which is a continuation-in-part application of U.S. patent application Ser. No. 15/632,873 filed on Jun. 26, 2017, which is a continuation application of U.S. patent application Ser. No. 15/432,009 filed on Feb. 14, 2017, which is a continuation application of U.S. patent application Ser. No. 15/113,837 filed on Jul. 24, 2016.

FIELD OF INVENTION

The present invention relates to a light bulb and more particularly related a LED light bulb.

BACKGROUND

In recent years, LED chips as illumination source used in indoor illumination field are developed rapidly. People continuously discover LED lamps that are easily manufactured and have stability. A traditional LED lamp structure mainly includes five parts of a bulb head, a driver, a radiator, a LED aluminum substrate and a bulb housing, where the LED aluminum substrate and the driver are of a separate style, and the driver and the LED light source are connected via melding. For example, the China invention patent, issued and published on Aug. 15, 2013 with patent No. 201320502252.5, disclosed a type of LED lamp structure piece. The LED lamp structure piece includes a lamp housing, a radiator, a LED light source plate, and a lamp cap, where the radiator includes a radiator base, cooling fin, and a hollow tube, the hollow tube is located below the radiator base and connected to the radiator base, and the hollow tube has a inside space for containing LED driver source.

Because the driver source is contained in the sleeve tube in the center of the radiator, when the driver source is connected with the LED source plate, electrical wires need to be go through the center of the radiator and fixed to the LED aluminum substrate via melding, which is complicated on assembling and causes high manufacturing cost.

SUMMARY OF INVENTION

According to an embodiment of the present invention, a light bulb apparatus is provided. The light bulb has a plurality of LED modules, a substrate, a driver circuit board, a plastic piece, a radiator and a lamp cap.

The LED module may contain one or more than one LED chips packaged as a unit. The LED refers to Light Emitted Diode, which has various related technology to convert electricity to light.

The LED modules are mounted on the substrate. The substrate may be implemented as a plate that has aluminum material for better heat dissipation. Please be noted that containing aluminum material does not mean the substrate needs to be a complete aluminum plate, which may also refer to any material containing aluminum or aluminum alloy mixed with other material.

The substrate has a first connection end and a second connection end. The first connection end and the second connection end are electrically connected to the LED modules, which mean that when the LED modules are supplied with electricity to provide light, the first connection end and the second connection end are electrically connected to the LED modules as conducting path for the LED modules.

The driver circuit board is used for converting outside electricity, e.g. with 220V or 110V, to a driving current with a suitable voltage and characteristic to drive the LED modules to emit light. Wireless controller for providing additional IoT (Internet of Things) function like Bluetooth control interface may also be disposed on the driver circuit board.

The plastic piece has a guiding groove for inserting the driver circuit board. In other words, when assembling the light bulb, the driver circuit board is inserted into the guiding groove of the plastic piece to make sure the driver circuit is located at corrected position to further connect to other components.

The radiator, which may be used for heat dissipation, has a top plate and a side wall. The substrate is fixed on the top plate, and the side wall is connected to the plastic piece. The top plate has a through hole.

The lamp cap has a first electrode and a second electrode. The first electrode is insulated from the second electrode. The driver circuit board is connected to the first electrode and the second electrode, e.g. with welded metal line or metal clip. The driver circuit board has two pins to pass through the through hole of the radiator to plug in two elastic strips of the second connection end. The second connection end is disposed on the backside of the substrate.

In some embodiments, the substrate is a metal disk with an insulation layer for installing a plug component with the second connection end at the back side of the substrate and with the first connection end at the front side of the substrate. In other words, the plug may be used for forwarding electricity from the back side of the substrate to the front side of the substrate, i.e. the driving current from the driver circuit board to the LED modules.

In some embodiments, there is certain heat dissipation gel applied between the substrate and the radiator. The LED modules and the driver circuit board are two major heat sources in the light bulb apparatus. The heat dissipation gel may be used to carry the heat generated by the LED modules to the radiator for better heat dissipation.

In some embodiments, the substrate and the radiator may be molded together with a molding machine. In other words, certain plastic with nice heat dissipation factor may be used to more closely fixing the connection between the substrate and the radiator.

In some embodiments, the side wall has an exterior surface directly contact with the inner surface of the plastic piece. In other words, such design helps carrying the heat on the radiator to the plastic piece, which may be used as the major outer housing of the light bulb.

In some embodiments, the radiator has a plurality of fins disposed between the side wall and the top plate. Such design increases heat dissipation efficiency by increasing more air contact area.

In addition, in some designs, the top plate may have an inner side wall. The plurality of fins have first fins ends connected to the inner side wall and have second fins ends connected to the side wall of the radiator. In such design, the top plate is connected to the side wall with the fins. There may even be fins holes connecting a top side and a bottom side of the radiator. With such fins holes, air may flow from the front side of the radiator to the backside or vice versa. When air is flown, heat dissipation usually has a better performance.

In some embodiment, the radiator is made of metal for performing heat dissipation. For example, copper or aluminum and their alloy are good option to make the radiator.

In some embodiments, the diameter of the top plate is smaller than 70% of the diameter of the side wall. In other words, in such design, the LED modules above the top plate are more closely to the center of the light bulb apparatus.

In some embodiments, the plastic piece has a supporting member for supporting the radiator. Specifically, certain lever, tube or structures with other shapes may be made extended from the main body of the plastic piece for supporting the radiator to keep the radiator more reliably.

In addition, the supporting member may further have an aligning plug to insert into an aligning hole of the radiator. In other words, the radiator may have certain holes to provide the aligning function. The supporting member has the aligning plug inserting into the aligning holes.

In some embodiments, the substrate is a circular disk. The LED components are disposed as a circular pattern with a diameter between 60% to 90% of the diameter of the circular disk of the substrate. In such design, the LED components are separated and arranged in the peripheral area of the substrate to get the light more focused.

In some embodiments, the plastic piece has a plurality of hook structures for hooking a bulb shell. With such design, the bulb shell where light is emitted through may be easily assembled to the plastic piece. Glue may also be used for enhancing reliability. Meanwhile, such design may be helpful for certain needs, e.g. changes or fixing components on the substrate.

In some embodiments, the bulb shell is a translucent plastic dome. The translucent dome ensures emitted light more softly and hides circuits on the substrate from the user to make a better appearance.

In some embodiments, the bulb apparatus may further have an optical reflector disposed above the substrate for guiding light emitted from the LED modules. Such optical reflector is designed for guiding the emitted light from the LED modules to designed paths. This makes customized light effect and increases visual effect of the bulb apparatus.

In some embodiments, the optical reflector may have a crown lens portion, a stand portion and a base portion. The base portion is placed on the substrate. The LED components are placed under the stand portion. The crown lens portion dispatches light with a crown pattern. In such design, emitted light from the LED modules enters the stand portion and moves into the crown portion to finally emitted in desired direction. With such design, the light bulb apparatus appears like a diamond when it is emitting light.

In some embodiments, the plastic piece has a cup portion and a support portion. The bottom of the support portion is connected to the lamp cap. The top of the cup portion is connected to the radiator. The diameter of the top of the cup portion is larger than the diameter of the support portion.

In some embodiments, the substrate may have a plurality of thin metal components respectively connecting the plurality of LED modules to form an interconnection among the plurality of LED modules. In other words, the LED modules are not connected with metal wires. Instead, thick plate segments that may conduct electricity are used for connecting the LED modules in series or in parallel, or in other arrangement. Other electronic components may also be disposed on the substrate.

In some embodiments, the plurality of thin metal components are covered by a insulation surface with white color material. With such design, the electricity is protected under the insulation surface to make the light bulb apparatus safer. The white color material helps reflects light to desired direction to increase light efficiency.

In some embodiments, there is a trench between the top and the side wall. This further increases rigid strength of the light bulb apparatus and also helps better perform heat dissipation.

The technical solution of the present invention is: a lamp cap electrical connection structure including a substrate, a plastic piece, and a lamp cap, in which the lamp cap includes a first electrode and a second electrode, the first electrode is insulated from the second electrode, the second electrode is fixed relative to the first electrode, the plastic piece is disposed above the first electrode, the substrate is fixed on the plastic piece, the substrate has electronic components and has a first connection end and a second connection end electrically connecting to the electronic components, the first electrode and the first connection end are electrically connected, the second electrode is a lever structure, the second connection end includes a connection part and a contact part, the connection part is electrically connected to the electronic components on the substrate, and the contact part is electrically connected to one end of the second electrode.

Compared with conventional art, the lamp cap electrical connection structure has electronic components and the LED light source disposed on the substrate at the same time and has the first connection end and the second connection end disposed on the substrate and electrically connected to the electronic components for the first electrode of the lamp cap being electrically connected to the first connection end, and for the second electrode of the lamp cap being electrically connected to the second connection end, so as to remove the need for disposing electrical wires for performing electrical connection and to perform electrical connection between the driver circuit and the lamp cap while fixing the substrate, and such design simplifies the structure, performs easy installation, has simple structures and is easy to be assembled automatically.

DETAILED DESCRIPTION

According to an embodiment of the present invention, a light bulb apparatus is provided. The light bulb has a plurality of LED modules, a substrate, a driver circuit board, a plastic piece, a radiator and a lamp cap.

The LED module may contain one or more than one LED chips packaged as a unit. The LED refers to Light Emitted Diode, which has various related technology to convert electricity to light.

The LED modules are mounted on the substrate. The substrate may be implemented as a plate that has aluminum material for better heat dissipation. Please be noted that containing aluminum material does not mean the substrate needs to be a complete aluminum plate, which may also refer to any material containing aluminum or aluminum alloy mixed with other material.

The substrate has a first connection end and a second connection end. The first connection end and the second connection end are electrically connected to the LED modules, which mean that when the LED modules are supplied with electricity to provide light, the first connection end and the second connection end are electrically connected to the LED modules as conducting path for the LED modules.

The driver circuit board is used for converting outside electricity, e.g. with 220V or 110V, to a driving current with a suitable voltage and characteristic to drive the LED modules to emit light. Wireless controller for providing additional IoT (Internet of Things) function like Bluetooth control interface may also be disposed on the driver circuit board.

The plastic piece has a guiding groove for inserting the driver circuit board. In other words, when assembling the light bulb, the driver circuit board is inserted into the guiding groove of the plastic piece to make sure the driver circuit is located at corrected position to further connect to other components.

The radiator, which may be used for heat dissipation, has a top plate and a side wall. The substrate is fixed on the top plate, and the side wall is connected to the plastic piece. The top plate has a through hole.

The lamp cap has a first electrode and a second electrode. The first electrode is insulated from the second electrode. The driver circuit board is connected to the first electrode and the second electrode, e.g. with welded metal line or metal clip. The driver circuit board has two pins to pass through the through hole of the radiator to plug in two elastic strips of the second connection end. The second connection end is disposed on the backside of the substrate.

Figure 5:
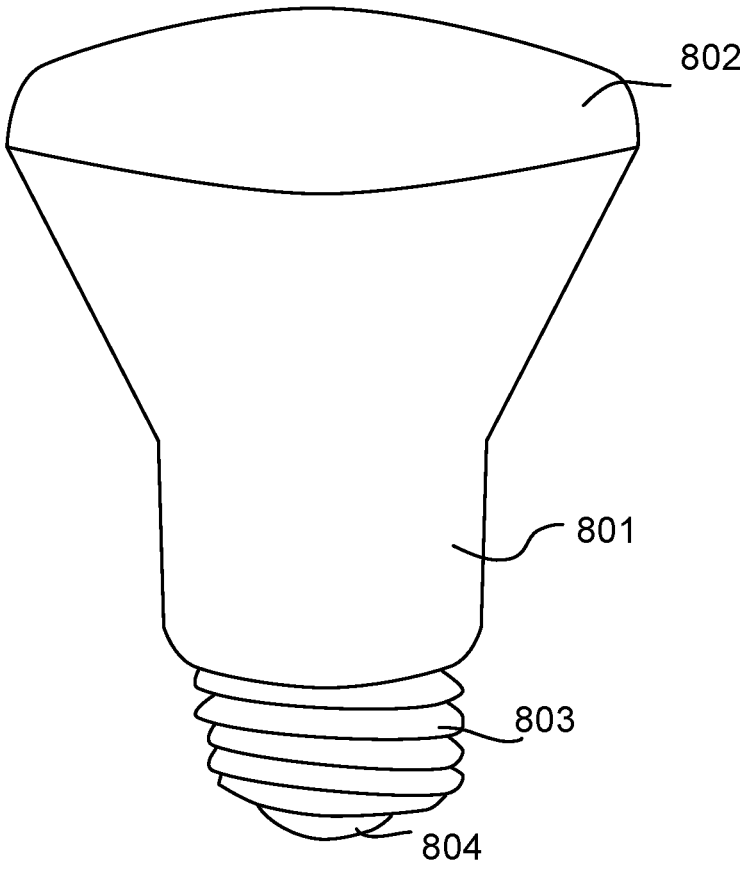
FIG. 5 is another embodiment of a light bulb.

Please refer to FIG. 5, which illustrates a side view of a light bulb embodiment. In this embodiment, the light bulb has a bulb shell 802, which may be translucent to emit light yet keeping the components in the bulb less visible and makes the emitted light more softly.

The bulb shell 802 is attached to a plastic piece 801. The plastic piece 801 further connected to a lamp cap with a first electrode 803 and a second electrode 804.

Figure 6:
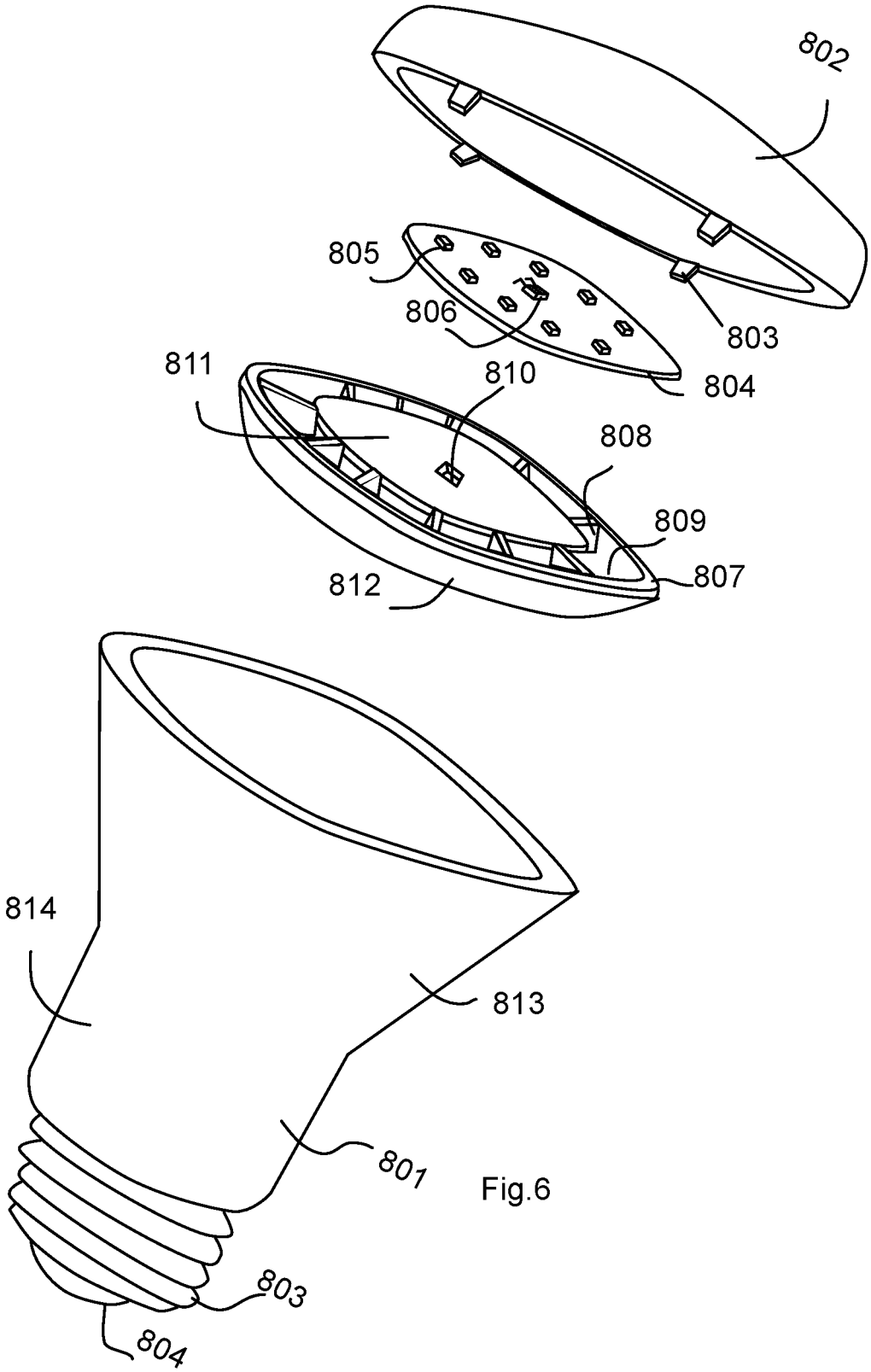
FIG. 6 is an exploded view of a portion of components of FIG. 5.

Please refer to FIG. 6, which illustrates some components of the embodiment in FIG. 5. The bulb shell 802 has some hook structures 803 to be attached to the plastic piece 801. The plastic piece 801 has a cup portion 813 and a support portion 814. The support portion 814 has a narrower diameter than the cup portion 813, which extends its diameter from bottom to top.

In FIG. 6, a substrate 801 carrying a plurality of LED modules 805 is provided. A plug 806 is also disposed at the center of the substrate 804. As explained in following description, the plug 806 forwards current from one side of the substrate 804 to the other side of the substrate 804 to drive the LED modules 805 to emit light.

In FIG. 6, the radiator 812 has a top plate 811 that has a through hole 810 in the central part, so that connecting pins of the driver circuit board may get through the through hole 810 to reach the plug 806.

The radiator 812 also has multiple fins 808 to increase touch area to air to better achieve heat dissipation. There are fins holes 809 between fins 808, which further improves heat dissipation efficiency. The fins 808 connect the top plate 811 and the side wall 807. The side wall 807 further engages with the interior surface of the plastic piece. In other words, heat from the LED modules 805 may be transmitted to the plastic piece 813 via the radiator 812.

Figure 7:
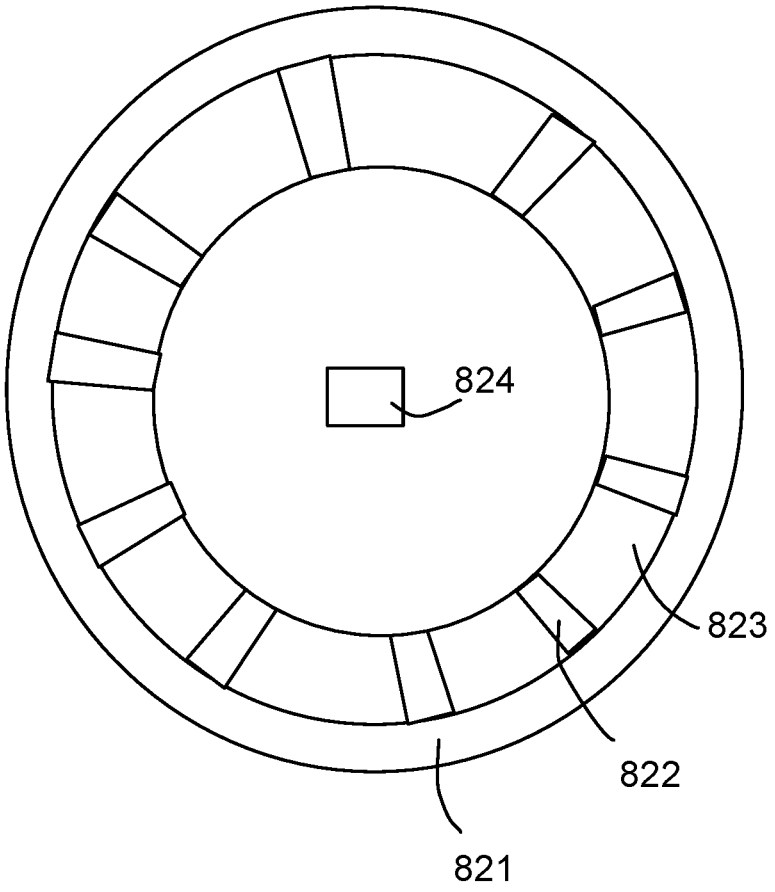
FIG. 7 illustrates a top view of a radiator embodiment.

Please refer to FIG. 7, which illustrates a top view of such radiator 821. It is clearly to see that there is a through hole 824 in the middle of a top plate. The top plate is connected to the side wall 821 with the fins 822. There are fins holes between the fins 822.

Figure 8:
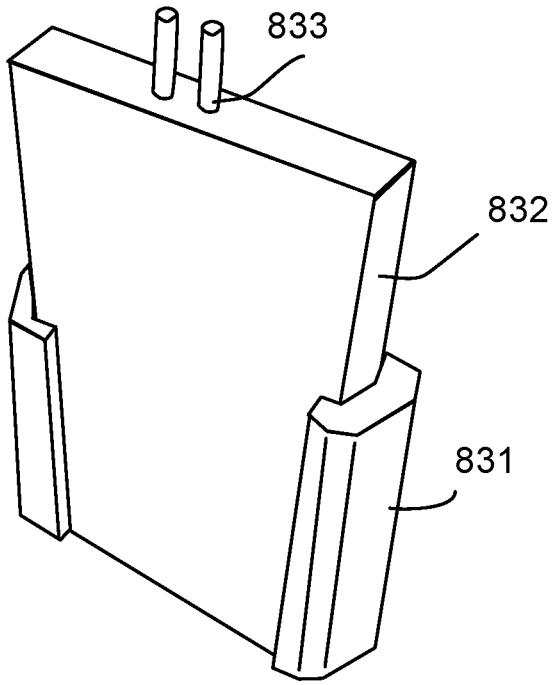
FIG. 8 illustrates a driver circuit board embodiment.

Please refer to FIG. 8, which illustrates a driver circuit board 832 is inserted into a guiding groove 831 of a plastic piece. The driver circuit board 832 has two pins 833 to be further inserted into a plug of a substrate that mounts LED modules. Such design makes assembling more convenient and thus saves manufacturing cost.

Figure 9:
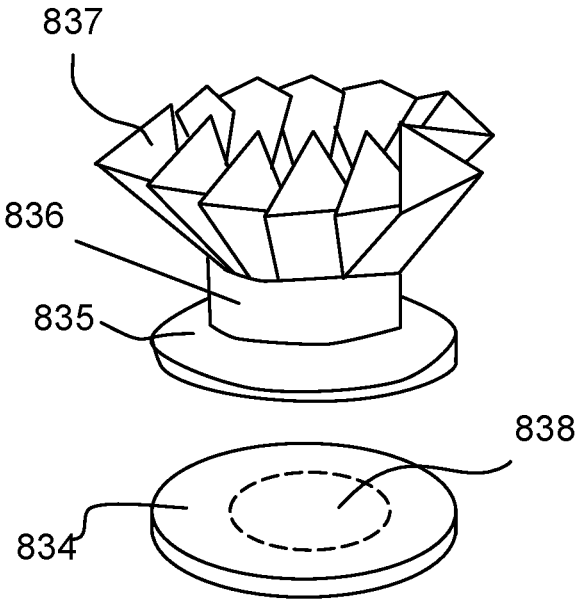
FIG. 9 illustrates an optical component of another embodiment.

Please refer to FIG. 9, which illustrates an optical reflector disposed above a substrate 834 for guiding light emitted from the LED modules. In FIG. 9, the optical reflector has a crown lens portion 837, a stand portion 836 and a base portion 835, the base portion 835 is placed on the substrate 834, the LED components are placed under the stand portion, the dashed circular area 838, and the crown lens portion 837 dispatches light with a crown pattern.

In some embodiments, the substrate is a metal disk with an insulation layer for installing a plug component with the second connection end at the back side of the substrate and with the first connection end at the front side of the substrate. In other words, the plug may be used for forwarding electricity from the back side of the substrate to the front side of the substrate, i.e. the driving current from the driver circuit board to the LED modules.

In some embodiments, there is certain heat dissipation gel applied between the substrate and the radiator. The LED modules and the driver circuit board are two major heat sources in the light bulb apparatus. The heat dissipation gel may be used to carry the heat generated by the LED modules to the radiator for better heat dissipation.

In some embodiments, the substrate and the radiator may be molded together with a molding machine. In other words, certain plastic with nice heat dissipation factor may be used to more closely fixing the connection between the substrate and the radiator.

In some embodiments, the side wall has an exterior surface directly contact with the inner surface of the plastic piece. In other words, such design helps carrying the heat on the radiator to the plastic piece, which may be used as the major outer housing of the light bulb.

In some embodiments, the radiator has a plurality of fins disposed between the side wall and the top plate. Such design increases heat dissipation efficiency by increasing more air contact area.

In addition, in some designs, the top plate may have an inner side wall. The plurality of fins have first fins ends connected to the inner side wall and have second fins ends connected to the side wall of the radiator. In such design, the top plate is connected to the side wall with the fins. There may even be fins holes connecting a top side and a bottom side of the radiator. With such fins holes, air may flow from the front side of the radiator to the backside or vice versa. When air is flown, heat dissipation usually has a better performance.

In some embodiment, the radiator is made of metal for performing heat dissipation. For example, copper or aluminum and their alloy are good option to make the radiator.

In some embodiments, the diameter of the top plate is smaller than 70% of the diameter of the side wall. In other words, in such design, the LED modules above the top plate are more closely to the center of the light bulb apparatus.

In some embodiments, the plastic piece has a supporting member for supporting the radiator. Specifically, certain lever, tube or structures with other shapes may be made extended from the main body of the plastic piece for supporting the radiator to keep the radiator more reliably.

In addition, the supporting member may further have an aligning plug to insert into an aligning hole of the radiator. In other words, the radiator may have certain holes to provide the aligning function. The supporting member has the aligning plug inserting into the aligning holes.

In some embodiments, the substrate is a circular disk. The LED components are disposed as a circular pattern with a diameter between 60% to 90% of the diameter of the circular disk of the substrate. In such design, the LED components are separated and arranged in the peripheral area of the substrate to get the light more focused.

In some embodiments, the plastic piece has a plurality of hook structures for hooking a bulb shell. With such design, the bulb shell where light is emitted through may be easily assembled to the plastic piece. Glue may also be used for enhancing reliability. Meanwhile, such design may be helpful for certain needs, e.g. changes or fixing components on the substrate.

In some embodiments, the bulb shell is a translucent plastic dome. The translucent dome ensures emitted light more softly and hides circuits on the substrate from the user to make a better appearance.

In some embodiments, the bulb apparatus may further have an optical reflector disposed above the substrate for guiding light emitted from the LED modules. Such optical reflector is designed for guiding the emitted light from the LED modules to designed paths. This makes customized light effect and increases visual effect of the bulb apparatus.

In some embodiments, the optical reflector may have a crown lens portion, a stand portion and a base portion. The base portion is placed on the substrate. The LED components are placed under the stand portion. The crown lens portion dispatches light with a crown pattern. In such design, emitted light from the LED modules enters the stand portion and moves into the crown portion to finally emitted in desired direction. With such design, the light bulb apparatus appears like a diamond when it is emitting light.

In some embodiments, the plastic piece has a cup portion and a support portion. The bottom of the support portion is connected to the lamp cap. The top of the cup portion is connected to the radiator. The diameter of the top of the cup portion is larger than the diameter of the support portion.

In some embodiments, the substrate may have a plurality of thin metal components respectively connecting the plurality of LED modules to form an interconnection among the plurality of LED modules. In other words, the LED modules are not connected with metal wires. Instead, think plate segments that may conduct electricity are used for connecting the LED modules in series or in parallel, or in other arrangement. Other electronic components may also be disposed on the substrate.

In some embodiments, the plurality of thin metal components are covered by a insulation surface with white color material. With such design, the electricity is protected under the insulation surface to make the light bulb apparatus more safely. The white color material helps reflects light to desired direction to increase light efficiency.

In some embodiments, there is a trench between the top and the side wall. This further increases rigid strength of the light bulb apparatus and also helps better perform heat dissipation.

Figure 1:
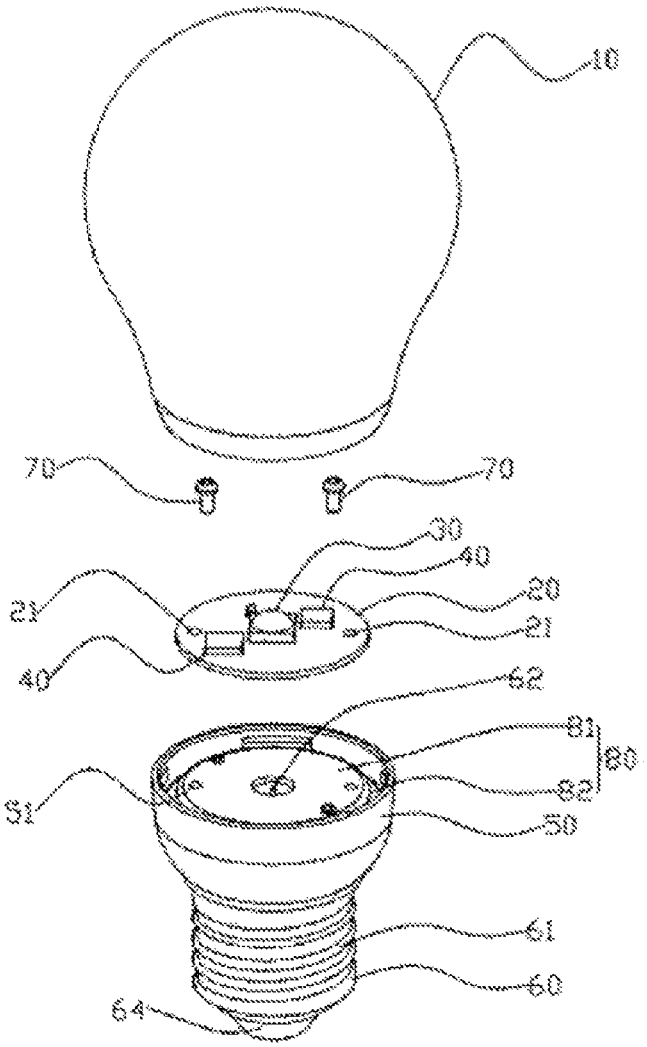
FIG. 1 is an exploded perspective diagram of a lamp cap electrical connection structure in a first embodiment of the present invention.
Figure 2:
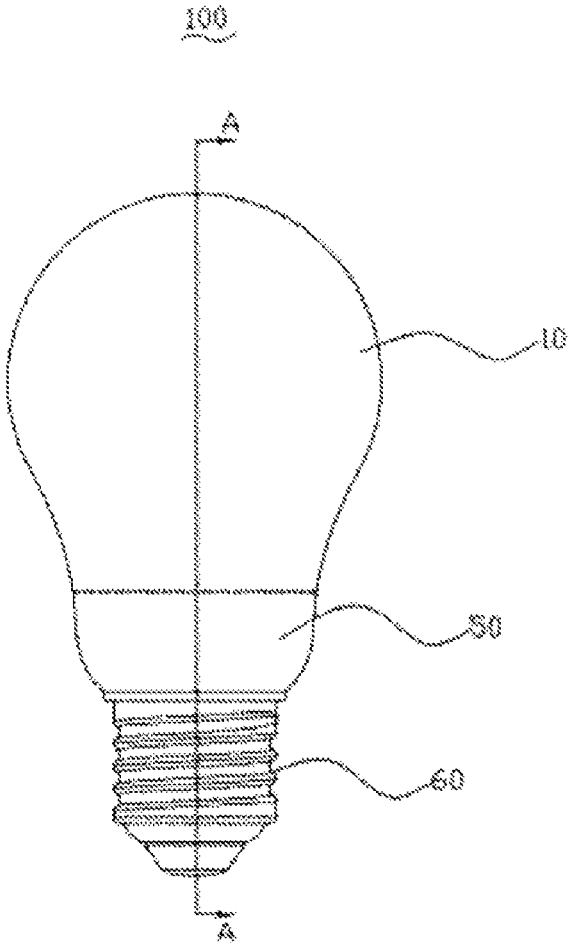
FIG. 2 is a main view diagram of the lamp cap electrical connection structure of FIG. 1.

FIG. 1 is an exploded perspective diagram of a new utility lamp cap electrical connection structure 100, where the lamp cap electrical connection structure 100 includes a substrate 20, a plastic piece 50, a lamp cap 60, and a radiator 80. FIG. 2 is a main view diagram of the lamp cap electrical connection structure of FIG. 1.

The lamp cap 60 includes a first electrode 61 and a second electrode 62, the first electrode 61 is insulated from the second electrode 62, and the second electrode 62 is fixed relative to the first electrode 61. The lamp cap 60 is a regular screw lamp cap, and the first electrode 61 is the lamp cap housing. The plastic piece 50 is disposed above the first electrode 61, and the substrate 20 is fixed on the plastic piece 50. The plastic piece 50 is a circular housing structure with openings on both its top and bottom. The substrate 20 has LED light source 30 disposed on its front side, and the LED light source is disposed in the middle of the substrate. The substrate 20 is also integrated with a driver IC chip 40, and also, other electronic components may be disposed and a circuit board may be used for connecting the electronic components. The radiator 80 includes a top plate 81 and a side wall 82 with integral forming, the substrate 20 is fixed on the top plate 81, the side wall 82 is disposed inside the plastic piece 50 and the plastic piece 50 insulates the side wall 82 from outside so that the lamp cap electrical structure 100 is complied with safety standard requirement.

Figure 3:
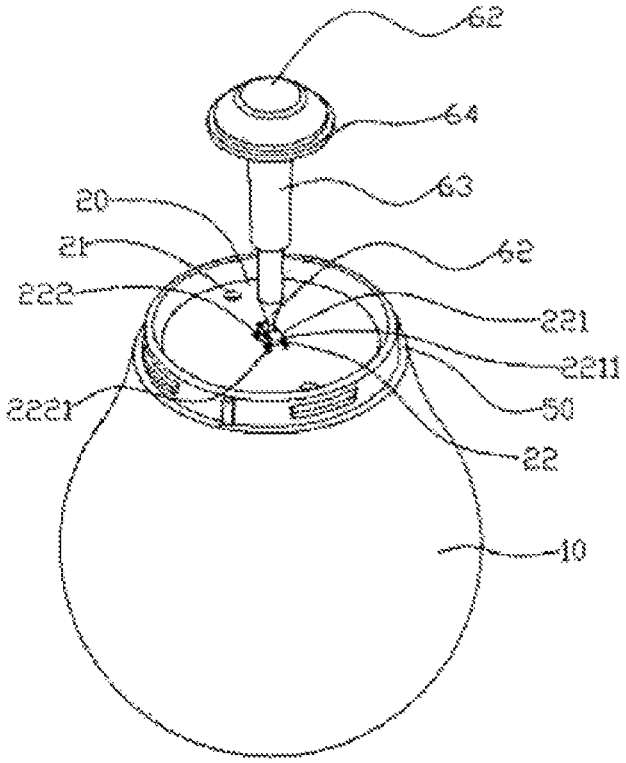
FIG. 3 is a perspective diagram of the lamp cap electrical connection structure of FIG. 1 by removing a plastic piece and a radiator along another angle.

Please refer to FIG. 3, in which the substrate 20 is an aluminum substrate, the substrate 20 has a first connection end 21 and a second connection end 22, the first electrode 61 and the first connection end are electrically connected, the second electrode 62 is a lever structure, the second connection end 22 includes a connection part 222 and a contact part 221, the connection part 222 is electrically connected to the electronic components on the substrate 20, and the contact part 221 is electrically connected to one end of the second electrode 62.

The first electrode 61 may further include an insulation sleeve 64, the insulation sleeve 64 is fixed at the bottom of the first electrode 61, the insulation sleeve 64 has a containing hole (not shown) in its middle part, and the second electrode 62 is disposed in the containing hole. A supporting sleeve 63 is disposed around the containing hole in the middle part of the insulation sleeve 64, the inner wall of the supporting sleeve 63 corresponds to the second electrode 62, the outer wall of the second electrode 62 has a barb (not shown), and the barb is hooked to the inner wall of the supporting sleeve 63. The second connection end 22 is disposed at the back side of the substrate 20, the contact part 221 includes a pair of elastic strips 2211 opposing to each other, and one end of the second electrode 62 is plugged between the two elastic strips 2211 to perform electrical connection. The connection part 222 is a sheet structure, the connection part 222 and the contact part 221 are made with integral forming, the connection part 222 has a connection pin 2221, and the connection pin 2221 is fixed at the back side of the substrate 20.

Figure 4:
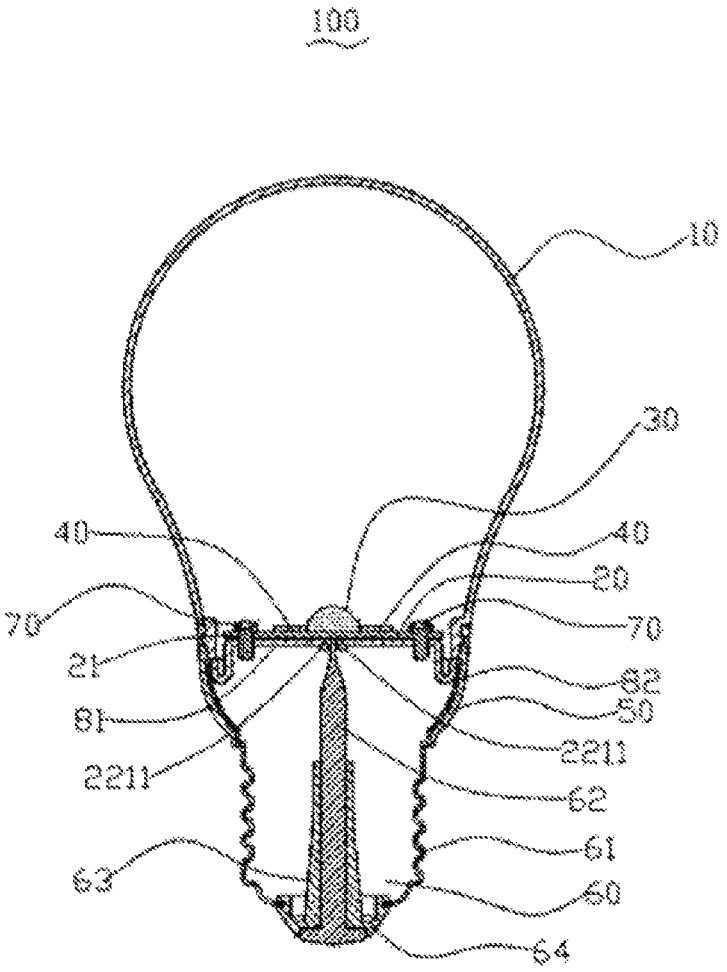
FIG. 4 is a sectional view along A-A line in FIG. 2.

Please refer to FIG. 4, in which the radiator 80 is made of conductive material, the side wall 82 of the radiator 80 is electrically connected to the first electrode 61, the first connection end 21 is disposed at the back side of the substrate 20, the substrate 20 is fixed at the top side of the top plate via a screw 70, and the first connection end 21 is electrically connected to the top plate 81 of the radiator 80.

During operation, the first connection end 21 of the substrate 20 is electrically connected to the top plate 81 of the radiator 80, and the first connection end 21 is able to electrically connect to the first electrode 61 because the side wall of the radiator 80 is electrically connected to the first electrode 61. The second connection end 22 disposed on the back side of the substrate 20 has two elastic strips 2211 disposed at its contact part 221 so that one end of the second electrode 62 with a lever structure is plugged between the two elastic strips 2211 so that the second connection end 22 is electrically connected to the second electrode 62. With such, the first connection end 21 and the second connection end 22 may supply electricity to the electronic components on the substrate 20 like LED light source 30 or the driver IC chip 40.

In summary, the lamp cap electrical connection structure 100 has both a driver IC chip 40 and LED light source 30 on its substrate 20 at the same time, and has the first connection end 21 and the second connection end 22 disposed on the substrate 20 and electrically connected to the electronic components on the substrate 20, so that the lamp cap has the first electrode 61 electrically connected to the first connection end 21 and the second electrode 62 electrically connected to the second connection end 22 to remove the need of disposing electrical wires for performing electrical connection and to perform electrical connection between the driver circuit and the lamp cap while fixing the substrate for simplifying structure and for having advantages of simple structure. In addition, the second connection end 22 is disposed at the back side of the substrate 20, not affecting the placement of the LED light source 30 on the front side of the substrate 20 so as to preserve larger space for light device design. The lamp cap 60 is not limited to screw head lamp, and may be other type of lamp cap like a socket lamp cap. It is only needed to change the second electrode 62 as a lever structure.

The invention claimed is:

1. A lighting apparatus comprising:

a plurality of LED modules;

a substrate comprising for mounting the plurality of LED modules, a first connection end and a second connection end, the first connection end and the second connection end being electrically connected to the plurality of LED modules;

a driver circuit board;

a wireless controller coupled the driver circuit board for connecting to an external device;

an optical reflector for guiding the plurality of the LED modules to change a light of the plurality of the LED modules; and a lamp cap with a first electrode and a second electrode, wherein the first electrode is insulated from the second electrode, the driver circuit board is connected to the first electrode and the second electrode, the driver circuit board has pins plugging in the second connection end, the second connection end is disposed on the backside of the substrate, wherein the substrate is a metal disk with an insulation layer for installing a plug component with the second connection end at the back side of the substrate and with the LED modules at the front side of the substrate, wherein the driver plate is inserted into a groove of the lamp cap so as to align the pins plugging in the second connection end.

2. The lighting apparatus of claim 1, wherein the plastic piece has a cup portion and a support portion, the bottom of the support portion is connected to the lamp cap, the top of the cup portion is connected to the radiator, and the diameter of the top of the cup portion is larger than the diameter of the support portion.

3. The lighting apparatus of claim 1, wherein there is a trench between the top and the side wall.

4. The lighting apparatus of claim 1, wherein the external device is an IoT device.

5. The lighting apparatus of claim 1, wherein the plastic piece has a plurality of hook structures for hooking a bulb shell.

6. The lighting apparatus of claim 5, wherein the bulb shell is a translucent plastic dome.

7. The lighting apparatus of claim 1, further comprising an optical reflector disposed above the substrate for guiding light emitted from the LED modules.

8. The lighting apparatus of claim 7, wherein the optical reflector has a crown lens portion, a stand portion and a base portion, the base portion is placed on the substrate, the LED components are placed under the stand portion and the crown lens portion dispatches light with a crown pattern.

9. The lighting apparatus of claim 1, wherein the substrate comprises a plurality of thin metal components respectively connecting the plurality of LED modules to form an interconnection among the plurality of LED modules.

10. The lighting apparatus of claim 9, wherein the plurality of thin metal components are covered by a insulation surface with white color material.

11. The lighting apparatus of claim 1, further comprising a radiator, the radiator comprising a top plate and a side wall, the substrate being fixed on the top plate, and the side wall being connected to the plastic piece, the top plate having a through hole, wherein the driver circuit board has two pins to pass through the through hole of the radiator to plug in two elastic strips of the second connection end.

12. The lighting apparatus of claim 11, wherein the substrate is a metal disk with an insulation layer for installing a plug component with the second connection end at the back side of the substrate and with the first connection end at the front side of the substrate.

13. The lighting apparatus of claim 12, wherein the side wall has an exterior surface directly contact with the inner surface of the plastic piece.

14. The lighting apparatus of claim 13, wherein the radiator has a plurality of fins disposed between the side wall and the top plate.

15. The lighting apparatus of claim 14, wherein the top plate has an inner side wall, the plurality of fins have first fins ends connected to the inner side wall and have second fins ends connected to the side wall of the radiator.

16. The lighting apparatus of claim 15, wherein there are fins holes connecting a top side and a bottom side of the radiator.

17. The lighting apparatus of claim 16, wherein the radiator is made of metal for performing heat dissipation.

18. The lighting apparatus of claim 16, wherein the diameter of the top plate is smaller than 70% of the diameter of the side wall.

19. The lighting apparatus of claim 18, wherein the plastic piece has a supporting member for supporting the radiator.

20. The lighting apparatus of claim 19, wherein the supporting member has an aligning plug to insert into an aligning hole of the radiator.

* * * * *